United States Patent [19]

Zbriger

[11] 4,377,918

[45] Mar. 29, 1983

[54] MULTI-FUNCTION TOY VEHICLE

[75] Inventor: Michael J. Zbriger, Bridgeport, Conn.

[73] Assignee: Aurora Products Canada Ltd., Ontario, Canada

[21] Appl. No.: 228,004

[22] Filed: Jan. 23, 1981

[51] Int. Cl.[3] ..... A63H 18/12

[52] U.S. Cl. ..... 46/257; 46/226

[58] Field of Search ..... 46/257, 258, 259, 262, 46/251, 253, 254, 255, 256, 226–231, 260, 261; 273/86 B

[56] References Cited

U.S. PATENT DOCUMENTS

| | | | |
|---|---|---|---|
| 4,156,987 | 6/1979 | Lahr | 46/259 X |
| 4,163,341 | 8/1979 | Jones et al. | 46/262 |
| 4,165,581 | 8/1979 | Wolf | 46/256 |

FOREIGN PATENT DOCUMENTS

| | | | |
|---|---|---|---|
| 2026331 | 2/1980 | United Kingdom | 46/262 |

*Primary Examiner*—Mickey Yu

*Attorney, Agent, or Firm*—Blum, Kaplan, Friedman, Silberman & Beran

[57] ABSTRACT

A multi-function toy vehicle is provided which may be used in connection with electric track games. The toy vehicle includes a chassis and a motor supported on the chassis for driving the vehicle. A DC voltage is supplied to the vehicle by a DC power source. The polarity of the voltage applied to the motor is selectively controlled by a remote controller. The toy vehicle performs a first function such as a forward driving when a voltage having a forward polarity is applied thereto. The toy vehicle performs at least a second function unrelated to driving or steering such as braking or powering a light on the vehicle when a voltage having a reverse polarity is applied thereto. The track game may include a simulated track or roadway on which the toy vehicle is guided. In such a track game, the voltage is applied to conductors in the form of rails on the track, the toy vehicle being coupled to the rails for receiving the applied voltage in either polarity.

12 Claims, 12 Drawing Figures

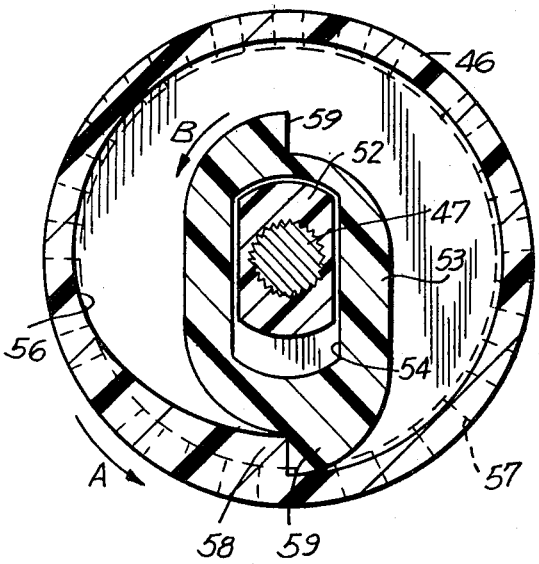
FIG.5
FIG.6
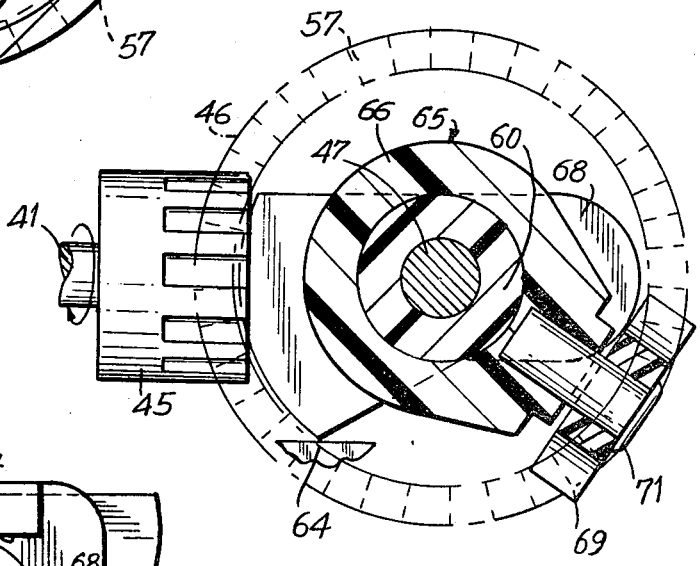
FIG.7
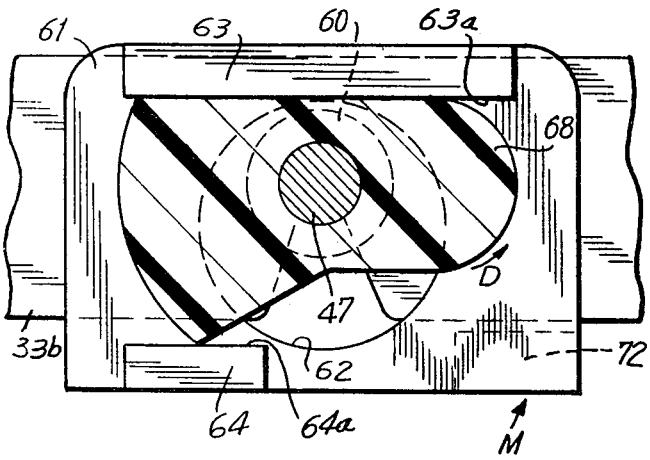
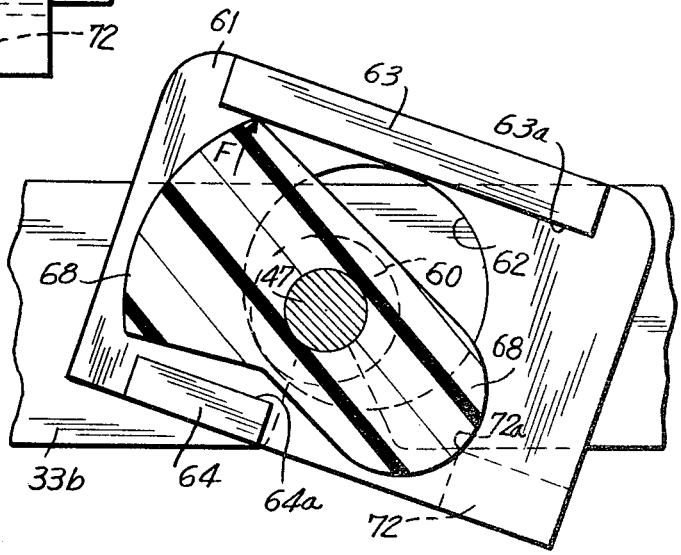
FIG.8

MULTI-FUNCTION TOY VEHICLE

BACKGROUND OF THE INVENTION

This invention relates to toy vehicles and in particular to toy vehicles for use in electric track games. Specifically, the invention relates to toy vehicles which perform multiple functions dependent upon the polarity of the voltage applied to the toy vehicle.

Track games, which have gained increased popularity in recent years, include a prearranged course on a roadway which simulates a street, highway or racetrack. The roadway is generally formed from interconnected track sections. Miniature toy vehicles are adapted to ride on the track. Power is supplied to the toy vehicles by conductors in the form of rails on the surface of the track to which a DC power source is coupled. The voltage applied to the rails is supplied to the toy vehicle by means of brushes or the like on the underside of the chassis of the toy vehicle. The toy vehicle is driven by a motor which is supported on the vehicle chassis which receives the voltage applied to the rails and brushes by the power source. The magnitude of the voltage applied to the motor is selectively controlled by a control mechanism. The greater the magnitude of the voltage applied to the motor, the faster the drive shaft of the motor will turn and, hence, the faster the vehicle will drive around the track.

Track games generally include two lanes for allowing simulated racing of toy vehicle on one lane of the track against a toy vehicle on the other lane of the track. Two types of track games and toy vehicles or use in connection therewith are available. The first type of track game includes a track having a slot in each lane of the track which is adapted to receive a downwardly projecting rod or pin on the toy vehicle for guiding the toy vehicle around the track and for insuring proper positioning of the toy vehicle brushes with respect to the rails on each lane of the track. This type of track game is referred to as a slot car track game. The second type of track game and toy vehicles for use in connection therewith is referred to the industry as a slotless system. In the slotless variety of track games, the toy vehicles can be selectively steered for permitting the toy vehicles to change lanes where more than one lane is provided on the track. Three rails are provided on each lane with each of two vehicles being driven by engagement of a pair of brushes on one pair of rails in each lane.

Conventional slotted and slotless track games and the toy vehicles used in connection therewith generally only allow the user to perform a single function, namely, the forward or reverse driving of the vehicle along the track. The speed of the vehicle can be controlled by selectively controlling the magnitude of the voltage applied to the motor in the toy vehicle. Reversal of polarity of applied voltage has been used to reverse direction of travel of the vehicle or to effect steering. Since it has been recognized that there are two opposite polarity DC voltages which can be applied to the rails on the track, various mechanisms have been provided heretofore which insure that the vehicle will drive in a forward direction regardless of the polarity of the voltage applied to the motor of the toy vehicle. For example, a double one-way clutch mechanism has been provided on the rear axle of the toy vehicle for insuring the forward driving of the toy vehicle on the track regardless of the direction of rotation of the drive shaft of the motor, even where the change of direction of the motor rotation is used for steering during forward travel of the toy vehicle.

In order to enhance the play value of toy vehicles and track games, it is desirable to have the toy vehicles perform as many functions as possible, preferably functions finding analogy in real vehicles, without unduly complicating the structure or increasing cost. It is known that actual racing cars or other vehicles perform selective functions other than driving or steering or have other features which have heretofore been readily available in toy vehicles or toy track games. For example, actual vehicles include brakes for slowing down or stopping the vehicle. Additionally, actual vehicles include a rear brake light which lights upon actuation of the brakes of the vehicle. Also, actual vehicles include selectively actuated headlights for lighting the roadway at night. Police cars include flashing lights on the roof thereof which are selectively actuated. Although these other functions are present in actual vehicles, the incorporation thereof into miniaturized toy vehicles for use in track games has not heretofore been readily realized. Separate remote control of lights has required transmitters and receivers or extra wires. The alternative, has been the provision of light switches on vehicles or continuous lighting of lights.

Accordingly, it is desired to provide a toy vehicle which performs multiple functions such as braking or lighting in addition to the driving or steering functions. By providing various toy vehicles incorporating a braking system or a lighting system which is controlled by a remote voltage polarity controller, the desired multifunction toy vehicle is provided.

SUMMARY OF THE INVENTION

Generally speaking, in accordance with the invention, a multi-function toy vehicle which may be used in connection with electrical track games is provided. The toy vehicle includes a chassis and a motor means supported on the chassis for driving the vehicle. A DC vehicle is supplied to the vehicle by a DC power source. The polarity of the voltage supplied to the vehicle is selectively controlled by the remote controller. The toy vehicle performs a first function such as a forward driving function when a voltage having a first polarity is applied to the toy vehicle. The toy vehicle performs at least a second function other than vehicle driving and steering when a voltage having a reverse polarity is applied to the vehicle.

The second function may be a braking function which simulates application of the brakes in an actual vehicle or a braking function and brake light combination. Alternatively, upon application of a reverse polarity voltage to the toy vehicle, a light can be powered while the vehicle is driving in the forward direction. In this alternative embodiment, the light can either be a headlight for a regular simulated car or a flashing light for a simulated police car or the like.

The track game may include a simulated track or roadway on which the toy vehicle is guided. In said track game, the voltage is applied through the controller, to conductors in the form of rails on the track, the toy vehicle being coupled to the rails for receiving the applied voltage in either polarity.

Accordingly, it is an object of the invention to provide an improved multi-function toy vehicle.

Another object of the invention is to provide an improved toy vehicle for use in track games which performs multiple functions.

A further object of the invention is to provide a toy vehicle for use in track games which performs different functions dependent upon the polarity of the voltage applied to the vehicle.

A still further object of the invention is to provide a toy vehicle which is driven in the forward direction when a first polarity is applied to the vehicle and is braked when a second, reverse polarity is applied thereto.

Yet another object of the invention is to provide a toy vehicle which includes a light which is selectively operated when a polarity opposite to the normal driving polarity of the voltage is applied to the vehicle.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 5, 6 and 7 are enlarged sectional views taken, respectively, along lines 5—5, 6—6 and 7—7 of FIG. 4;

FIG. 8 is a sectional view similar to FIG. 7 depicting the braking mechanism in operation;

DESCRIPTION OF THE PREFERRED EMBODIMENTS

Figure 1:
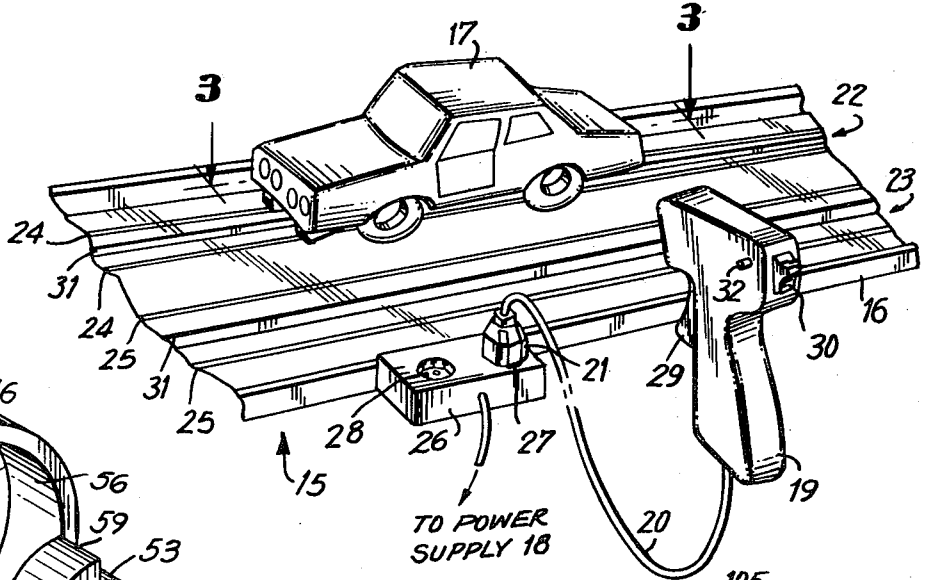
FIG. 1 is a perspective view of a portion of a two lane track game utilizing a toy vehicle constructed in accordance with a first embodiment of the instant invention.

Reference is first made to FIG. 1 wherein a portion of a track game generally indicated at 15 is depicted. Track game 15 includes a track 16 on which a toy vehicle 17 is guided. In a complete track game, track 16 forms a continuous simulated highway or racetrack on which toy vehicle 17 is driven.

Track 16 may be any type of track including both the slotted and slotless varieties presently available for use with a corresponding slotted or slotless toy vehicle 17 as the case may be. Toy vehicle 17 is electrically powered by a DC power supply 18. A hand held controller 19 couples DC power supply 18 to track 16 by means of four wire lead 20 and electrical coupling 21.

As depicted in FIG. 1, track 16 includes two parallel lanes indicated as 22 and 23. Each lane 22 and 23 includes a pair of conductors or rails 24 and 25, respectively, which are electrically coupled to a coupling box 26. Coupling box 26 includes receptacles 27 and 28 for receiving the electrical coupling 21 from controller 19. Only one controller 19 is depicted in FIG. 1. However, a second controller, not shown, can be coupled to receptacle 28 for providing power to rails 26 on lane 23 of track 16. Controller 19 includes a trigger 29 for controlling the magnitude of the voltage from power supply 18 applied across conductors 24. Controller 19 also includes a biased switch 30 for selectively changing (reversing) the polarity of the DC voltage applied to conductors 24.

Figure 1A:
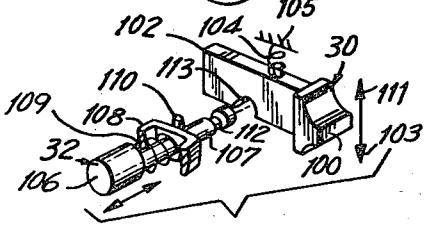
FIG. 1A is an exploded enlarged perspective view of the voltage polarity control switch of the controller of FIG. 1.

As depicted in FIG. 1A, biased switch 30 includes a manually engageable head portion 100 and a body portion 102 bearing electrical contacts (not shown but discussed in connection with FIG. 9). Switch 30 is biased in the direction of arrow head 103 by a coil spring 104 captured between wall 105 and the top surface of body 102. A lock button 32 is mounted for axial displacement in response to manual pushing on head portion 106. The body 107 of the lock button 32 is journaled through a hole in the casing of controller 9 and through a hole in internal wall 108. A coil spring 109 is captured between head 108 and internal wall 108 to bias the lock button in an outer position. The limit of outer displacement of lock button 32 is defined by a pin 110 mounted on body 107 on the inside of internal wall 108. When biasing switch 30 is displaced in the direction of arrow head 111, the polarity of the voltage applied to the rails is reversed. When in the upper position, lock button 32 can be displaced inwardly until notch 112 on the body 107 thereof interengages with notch 113 on body 102 of switch 30 to hold the switch in the upper position. The switch is released and returned to the lower position by further upward displacement to release the biased lock button 32 and release of the biased switch 30.

As depicted in FIG. 1, each lane 22 and 23 includes a slot 31 and 31' respectively for guiding toy vehicle 17 around track 16. As aforenoted however, the instant invention is not restricted to slotted tracks and as hereinafter described, the toy vehicle 17 can be used in connection with other types of tracks such as slotless tracks.

Figure 3:
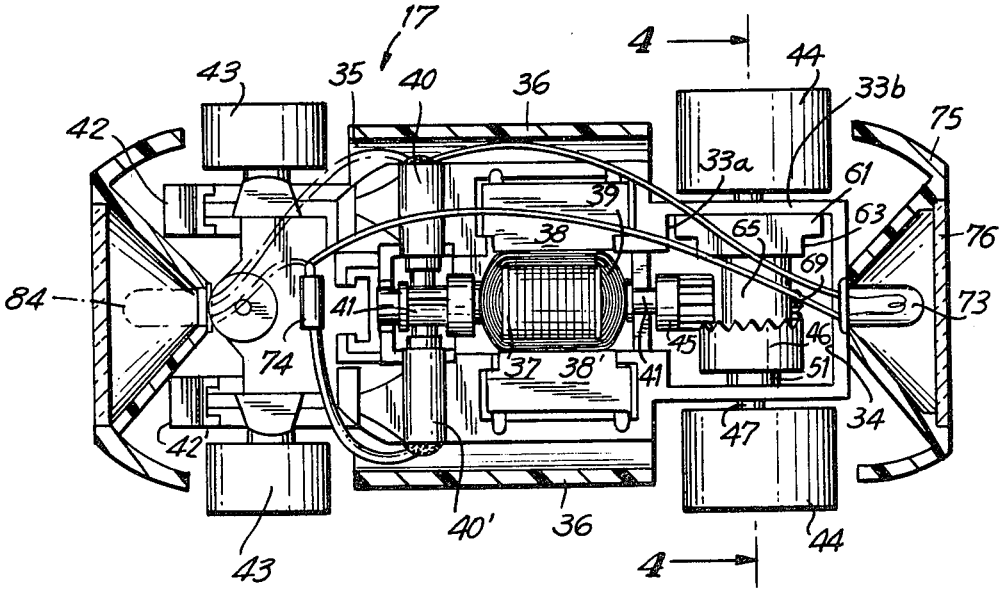
FIG. 3 is an enlarged sectional view taken along lines 3—3 of FIG. 1.

Referring to FIG. 3, the construction of toy vehicle 17 will be described. Vehicle 17 includes a chassis 35 which supports body 36 of the vehicle. A motor 37 for driving the vehicle includes permanent magnets 38 and 38' on either side of rotor 39 of motor 37. Motor brushes 40 and 40' are electrically coupled to drive shaft 41 of motor 37. Motor brushes 40 and 40' are electrically coupled to conductor brushes 42 and 42' on the underside of chassis 35. Conductor brushes 42 and 42' contact rails 24 on track 16 and apply the voltage applied to rails 24 by power supply 18 to brushes 40 and 40', and hence to motor 37 for powering same.

Front wheels 43 and rear wheels 44 are rotatably coupled to chassis 35. A pinion 45 is secured to drive shaft 41 of motor 37 and is meshingly engaged with face gear 46 mounted on rear axle 47 of rear wheels 44 as described below in detail.

Referring now to FIGS. 1 through 9, the toy vehicle and track game constructed in accordance with a first embodiment of the instant invention will be described.

As aforenoted, controller 19 includes a switch 30 for reversing the polarity of the voltage applied to rails 24 and hence to motor 37 by means of brushes 42 which contact rails 24 when vehicle 17 is on track 16. The magnitude of the voltage is controlled by a potentiometer 50 (FIG. 9) which is operated by a spring biased trigger 29 on controller 19. When a first (forward) polarity of the voltage is applied to motor 37, switch 30 being in the first position depicted in full lines in FIG. 9, drive shaft 41 will rotate in a first direction causing forward driving of vehicle 17 as hereinafter described. When switch 30 is activated and moved to its second position as depicted in phantom in FIG. 9, so as to reverse the polarity of the voltage applied to motor 37, drive shaft 41 will rotate in the opposite direction and a second function will be performed by vehicle 17 as hereinafter described.

Figure 4:
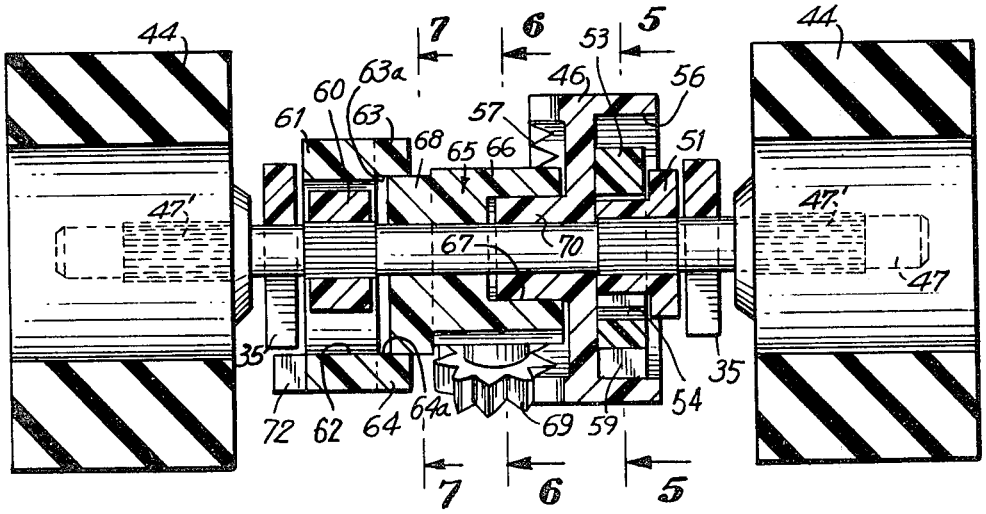
FIG. 4 is an enlarged sectional view taken along lines 4—4 of FIG. 3.

Rear wheels 44 are secured to opposite ends of rear axle 47 by means of knurled portions 47' on the ends of rear axle 47 (FIG. 4). In a first embodiment of the invention, rear axle 47 also supports the driving clutch mechanism and a braking mechanism as hereinafter described. A sleeve 51 is fixedly secured to axle 47 by means of a knurled portion provided therefor, for rotation therewith. Sleeve 51 includes a projection 52 of noncircular cross-section which is received in opening 54 in a clutch plate 53. Opening 54 is of essentially the same width as projection 52 but of greater height as that clutch plate 53 is displaceable laterally of axle 47 of projection 52. Face gear 46 includes a recess on one side thereof defining an inner camming surface 56 for receiving and guiding clutch plate 53 therein. Camming surface 56 includes a stepped region 58. The outer periphery of clutch plate 53 is formed with a pair of spaced projections 59. Clutch plate 53 and camming surface 56 operate together as a one-way clutch mechanism.

The operation of the clutch mechanism will be explained with reference to FIG. 5. When face gear 46 is caused to rotate in the direction of arrow A by pinion 45 on drive shaft 41 of motor 37, stepped region 58 in camming surface 56 will engage against one of the two projections 59 on clutch plate 53. Clutch plate 53 will accordingly be caused to rotate in the direction of arrow B which in turn will cause sleeve 51 secured to axle 47 to rotate, thereby causing axle 47 to rotate. Wheels 44 will rotate and will cause car 17 to move in a forward direction.

When face gear 46 is caused to rotate in a direction opposite to the direction of arrow A, camming surface 56 and stepped region 58 will slide around the outer surface of clutch plate 53. As noted above, opening 54 in clutch plate 53 is longer than the lengthwise extent of projection 52 on sleeve 51, as best viewed in FIG. 5, thereby allowing clutch plate 53 to be reciprocably displaced up and down and camming surface 56 to slide around the outer surface of clutch plate 53, so that axle 47 is not rotated.

Referring additionally to FIGS. 2 through 4 and 6 through 8, brake drum 60 is fixedly secured to axle 47 by means of a knurled portion on axle 47 provided therefor. A brake shoe 61 is loosely supported on axle 47 and includes a circular opening 62 in which brake drum 60 rides. Brake shoe 61 also includes a first projecting ledge 63 on the trigger periphery of the side thereof facing face gear 46 and having a first bottom camming surface **63*a*, and a second projecting ledge 64 on the lower periphery of the side facing face gear 46 and having a second top camming surface 64*a*. A cam body 65 is rotatably supported on axle 47 intermediate face gear 46 and brake shoe 61. Cam body 65 includes a substantially cylindrical portion 66 which is formed with an opening 67 through which axle 47 extends and a cam portion 68 which is positioned intermediate first camming surface 63*a* and second camming surface 64*a* on brake shoe 61. Substantially cylindrical portion 66 of cam body 65 supports a pinion gear 69 which is rotatably secured thereto by means of a radially extending eyelet or the like. Pinion 69 is meshingly engaged with teeth 57 on face gear 46. Face gear 46 includes a reduced diameter cylindrical projection 70 which is received in opening 67 of cam body 65 to provide stable guidance for face gear 46 and to insure the meshing engagement of pinion 69 with face gear 46. As best viewed in FIG. 3, brake shoe 61 is positioned between rear wall 34, facing stub wall 33*a* and the adjacent side wall 33*b* of chassis 35. Said side wall 33*b* serves as one rotatable support for axle 47. Brake shoe 61 also includes a projection 72 on the outer side thereof (facing and projecting beneath side wall 33*b* of chassis 35**), the purpose of which will be explained below.

The operation of the braking mechanism will now be described. When face gear 46 is caused to rotate in the direction of arrow A (FIG. 2) thereby causing axle 47 to rotate in the manner described above, pinion 69 will be caused to rotate in the direction of arrow C which in turn urges cam body 65 in the direction of arrow D. (FIGS. 2 and 7) In effect, pinion 69 acts as a planetary gear. Cam portion 68 bears against camming surface **64*a*. Projection 72 on brake shoe 61 will be urged in the direction of arrow M as viewed in FIG. 7 and the brake shoe will remain in its normally essentially horizontal position as depicted in FIG. 7. The brake shoe is thus held against the chassis with the wall of circular opening 62 thereof out of contact with base drum 60. (See FIG. 7). Accordingly, brake drum 60 will freely rotate in circular opening 62 of brake shoe 61. Vehicle 17 will thus move in a forward direction without any braking occurring. However, when the polarity of voltage of motor 37 is reversed by means of switch 30, the motor will rotate in the opposite direction and the rear wheels will not be driven due to the operation of the one-way clutch described above. Without the braking mechanism described herein, car 17 would eventually roll to a stop. However, by providing a braking mechanism which is operational when the polarity of the voltage is reversed, car 17** can be caused to slow down and stop more quickly and realistically than in the conventional toy car.

Figure 2:
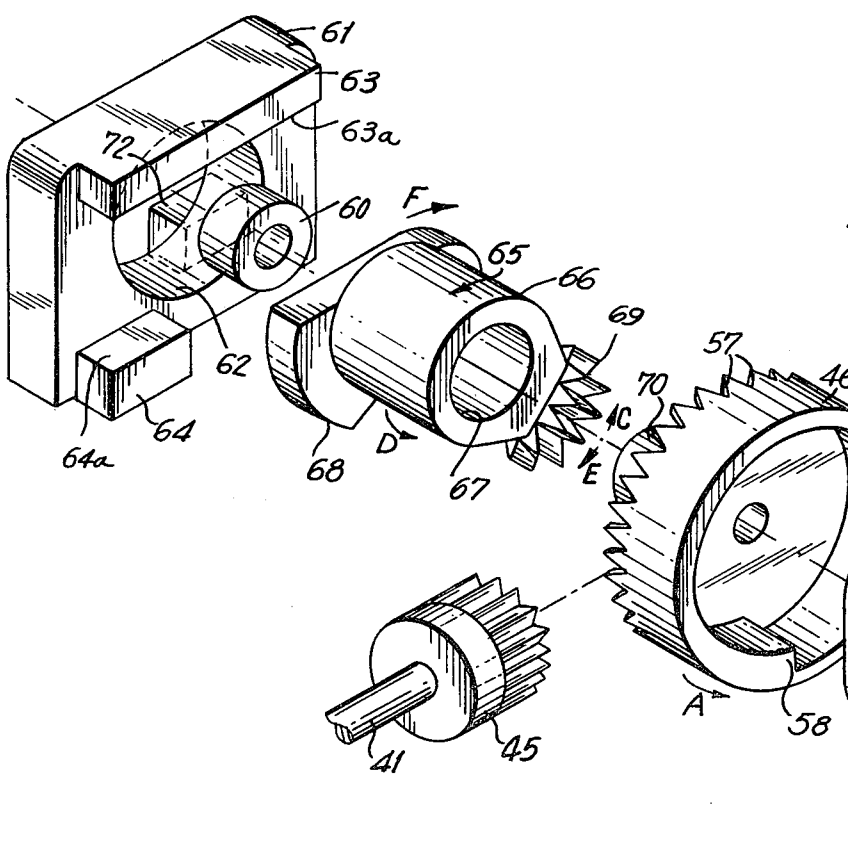
FIG. 2 is an exploded perspective view of the rear axle clutch and braking mechanism of the toy vehicle depicted in FIG. 1.

When face gear 46 is caused to rotate in the direction opposite to the direction of arrow A (FIG. 2) due to the reversed polarity voltage applied to motor 37, pinion 69 on cam body 65 will be caused to rotate in the direction of arrow E and will force cam body 65 to rotate in the direction of arrow F. (FIGS. 2 and 8). With reference to FIG. 8, when cam portion 68 is forced in the direction of arrow F, it engages against first camming surface 63 on brake shoe 61. Brake shoe 61 will accordingly pivot about the corner **72*a* of projection 72 which contacts the bottom of side wall 33*a* of chassis 35. The surface of circular opening 62 is brought into engagement with brake drum 60 thereby causing vehicle 17 to brake, slow down and stop due to the frictional rubbing of brake drum 60 against the surface of circular opening 62. In this manner, a braking mechanism is provided in a toy vehicle which is operational when a reverse polarity is applied to motor 37 causing the drive shaft 41 thereof to rotate in the opposite direction. In an alternate embodiment, the chassis can be dimensioned so that brake shoe 61 is guided between chassis walls 33a and 34** for displacement upwardly without tilting to effect braking.

Figure 9:
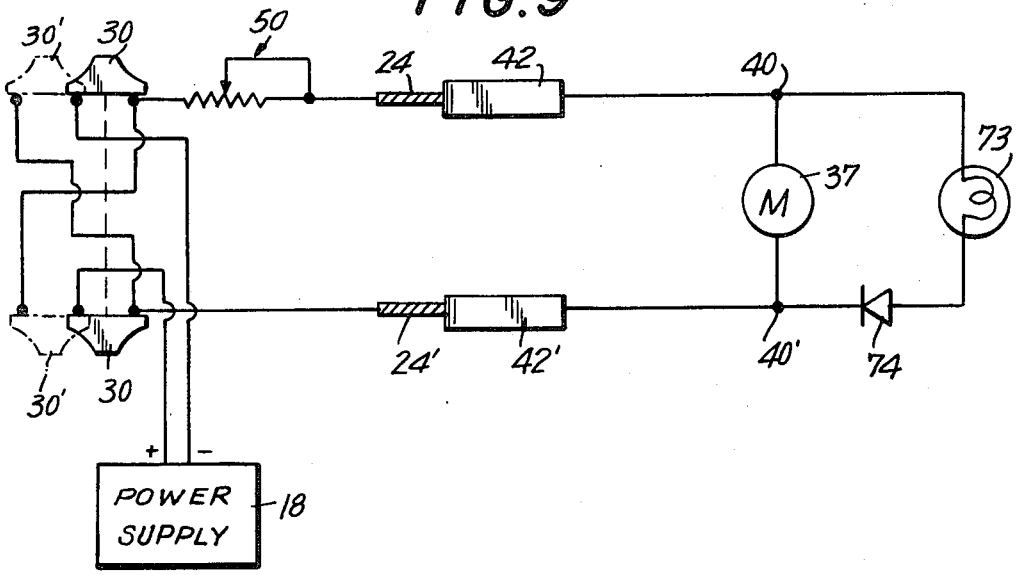
FIG. 9 is a schematic diagram of the circuit utilized in connection with the toy vehicle and track game depicted in FIG. 1.

Referring now to FIG. 9, switch 30 is a double pole double throw switch adapted to reverse the polarity of the voltage applied to rails 24 from power supply 18. When switch 30 is in the position depicted in FIG. 9, a positive terminal of power supply 18 will be coupled to rail 24. When the switch 30 is switched to the position depicted in phantom as 30' in FIG. 9, the positive terminal power supply 18 will be coupled to rail 24 and the negative terminal will be coupled to rail 24' thereby reversing the polarity of voltage applied across motor 37.

Referring to FIGS. 3 and 9, where the reverse polarity voltage is applied to motor 37 so that rear axle 47 is not driven and the braking mechanism is operational, a brake light 73 can be provided. Brake light 73 is coupled to power supply 18 by means of brushes 40 and 40'. A diode 74 is coupled intermediate brush 40' and brake light 73 so that brake light 73 is only operational when the reverse polarity voltage is applied across brushes 40 and 40'. Thus, when the reverse polarity is applied, not only will the braking mechanism be operated, but also brake light 73 will light thereby further providing realistic simulation of an actual racing car or automobile in miniature toy vehicle 17. It is noted that body 36 of toy vehicle 17 can include a member 75 for receiving brake light 73 and for directing the light therefrom through a lens plate 76. Lens plate 76 can be colored red so as to further simulate an actual braking light.

Figure 10:
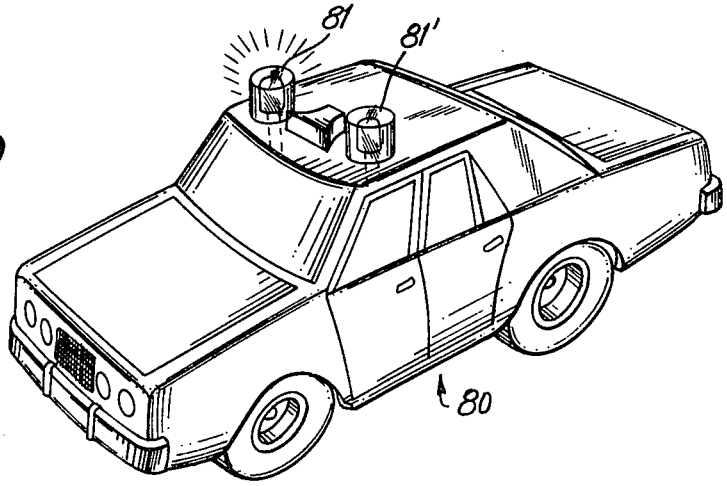
FIG. 10 is a perspective view of an alternative embodiment of the toy vehicle in accordance with the invention.
Figure 11:
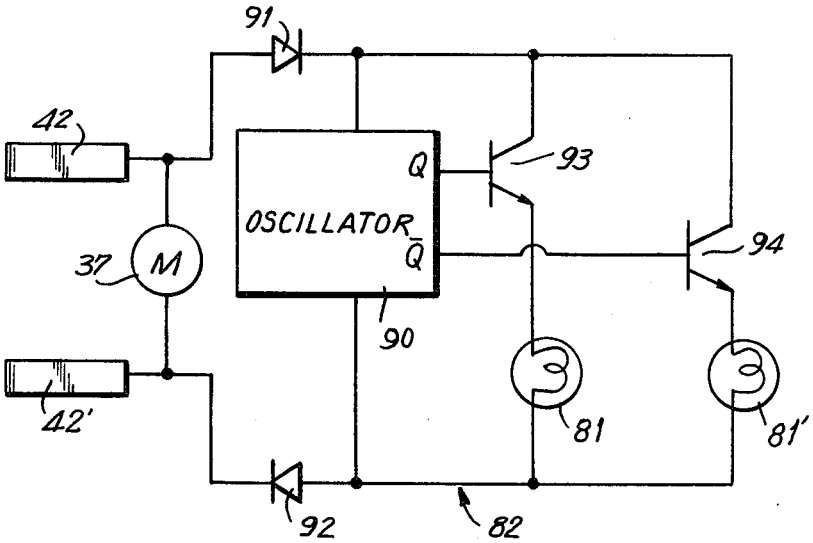
FIG. 11 is a schematic diagram of the circuit utilized in the toy vehicle depicted in FIG. 10.

Referring now to FIGS. 10 and 11, an alternative embodiment of the instant invention is depicted. A simulated police car, generally indicated as 80, includes a conventional double one way clutch mechanism (not shown) so that car 80 is driven in a forward direction regardless of the polarity of the voltage applied to motor 37 thereof. The double clutch may be formed by providing a mirror image of the clutch mechanism of FIGS. 2–5 in addition to the existing clutch mechanism. In other words, two face gears, two sleeves and two clutch plates would be provided, one set operative in each direction of motor drive. An example of a double clutch is contained in U.S. application Ser. No. 4,952, filed Jan. 19, 1979, the disclosure of which is incorporated herein by reference. However, car 80 is provided with bulbs 81 and 81' on the top thereof to simulate the flashing lights on the roof of an actual police car. Bulbs 81 and 81' are coupled to an alternating flasher circuit generally indicated at 82 for alternatively flashing lights 81 and 81'.

Alternating flasher circuit 82 includes an oscillator 90 in the form of a chip or the like having two alternative and opposite outputs, Q and $\overline{Q}$. Oscillator 90 is coupled to contact rails 42 and 42' through diodes 91 and 92 respectively. A transistor 93 is coupled intermediate output Q and of oscillator 90 and bulb 81, and a transistor 94 is coupled intermediate output $\overline{Q}$ and bulbe 81'. When a first polarity of voltage is applied across contacts 42 and 42', motor 37 will be operated and will cause the car to move forward in a forward direction. Diodes 91 and 92 will prevent current from passing into oscillator 90 so that the bulbs are not lit. However, when a revers polarity is applied across contacts 42 and 42', motor 37 will rotate in the opposite direction. The double one way clutch mechanism provided on the rear axle of car 80 will cause motor 37 to continue driving car 80 in a forward direction. When the reverse polarity is applied, diodes 91 and 92 will allow the current to pass therethrough and oscillator 90 in conjunction with transistors 93 and 94 will operate bulbs 81 and 81' which will alternately flash on the top of police car 80.

In a third embodiment of the invention, with reference to FIG. 3, alternating flasher circuit 82 and bulbs 81 and 81' can be replaced with a headlight bulb 84 coupled to contacts 40 and 40' through a diode 74 which will be turned on when a reversed polarity voltage is applied across contacts 42 and 42' in the manner discussed above with respect to police car 80.

The toy vehicles described above for use in connection with the track games described herein provide a multi-function toy vehicle which does more than just drive at varying speeds or permit steering. The toy vehicles disclosed herein more realistically simulate actual automobiles and racing cars and provide enhanced play value to toy vehicles and to track games. All of the new functions of the toy vehicles are controlled by merely reversing the polarity of the voltage applied to the toy vehicle.

It will thus be seen that the objects set forth above, among those made apparent from the preceding description, are efficiency attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statement of the scope of the invention which, as a matter of language, might be said to fall therebetween.

What is claimed is:

1. A toy vehicle powered by a DC voltage source comprising a chassis, wheels rotatably coupled to said chassis by supporting same, motor means supported by said chassis and driven by said DC voltage from said source, means for mechanically coupling said motor means to at least one of said wheels for the driving of the vehicle, means for selectively remotely controlling the polarity of the DC voltage applied to said motor means, said motor means driving said at least one wheel at least when a first polarity of DC voltage is applied thereto, and vehicle-related second function means mounted on said chassis for performing at least a second function when a DC voltage of a second polarity is applied to said motor means, the direction of rotation of said motor means varying with the polarity of applied DC voltage, and including one-way clutch means intermediate said motor means and said driven wheel so that said wheel is driven only when said motor means rotates in the direction produced by a DC voltage of said first polarity, said second function means including vehicle braking means mechanically coupled to said motor means for effecting braking only when a DC voltage of said second polarity is applied to said motor means.

2. The toy vehicle as claimed in claim 1, including an axle rotatably mounted on said chassis and coupled to said driven wheel for rotation therewith, brake drum means mounted on said axle for rotation therewith, brake shoe means supported for displacement between a first position out of engagement with said brake drum means and a second braking position in engagement with said brake shoe means, and means operatively coupling said motor means and said brake shoe means for holding said brake shoe means in said first position when said motor means is driven by said first polarity DC voltage and for displacing said brake shoe means from said first position to said second position when said motor means is driven by said second polarity DC voltage.

3. The toy vehicle as claimed in claim 2, wherein said brake shoe means is formed with an opening therethrough which extends about said brake drum means and is of a larger dimension than said brake drum means, said brake shoe means further including camming surfaces, said coupling means between said motor means and brake shoe means including pivotably mounted cam means positioned for operative engagement against said brake shoe means camming surfaces for the positioning and displacement thereof.

4. The toy vehicle as claimed in claim 3, wherein said means coupling said motor means and said brake shoe means includes gear means operatively coupled to said motor means for rotation thereby, planetary gear means rotatably mounted on said cam means and operatively engaged with said first-mentioned gear means for rotation thereby, and further including stop means for limiting the displacement of said brake shoe means, whereby the rotation of said motor means in the driving direction is transmitted in said planetary gear means to said cam means to hold the brake shoe means at said first position, and whereby when said motor means is driven in the reversed direction by said second polarity DC voltage, the displacement of said planetary gear means acting through said cam means displaces said brake shoe means to said second position for effecting braking of the toy vehicle.

5. The toy vehicle as claimed in claim 1, wherein said second function means further includes brake light means and diode means both supported by said chassis, and means electrically connecting said brake light means and diode means to said DC voltage source, whereby said brake light means are lit only when said second polarity DC voltage is applied thereto.

6. A toy vehicle powered by a DC voltage source comprising a chassis, wheels rotatably coupled to said chassis by supporting same, motor means supported by said chassis and driven by said DC voltage from said source, means for mechanically coupling said motor means to at least one of said wheels for the driving of the vehicle, means for selectively remotely controlling the polarity of the DC voltage applied to said motor means, said motor means driving said at least one wheel at least when a first polarity of DC voltage is applied thereto, and vehicle-related second function means mounted on said chassis for performing at least a second function when a DC voltage of a second polarity is applied to said motor means, said second function means including light means and diode means both supported on said chassis, and means electrically connecting said light means and diode means to said DC voltage source, whereby said light means is lit only when a DC voltage of a second polarity is applied to said motor means.

7. The toy vehicle as claimed in claim 6, wherein said light means is positioned on said chassis to simulate headlights.

8. The toy vehicle as claimed in claim 6, wherein said light means is positioned on said chassis to simulate the brake lights.

9. The toy vehicle as claimed in claim 6, including two of said light means positioned on said chassis to simulate emergency vehicle lights, and including circuit means supported by said chassis and electrically connected intermediate said two light means and two diode means for alternatively lighting said two light means when said second polarity DC voltage is applied to said motor means.

10. A toy vehicle as claimed in claims 1, 6, 7, 8 or 9, for use in connection with an electric track game having track means, rail means on said track means and means coupling said DC voltage to said rail means, and including means supported by said chassis for electrically coupling said rail means to said motor means when said vehicle is on said track.

11. A toy vehicle as claimed in claim 10, including manually operable controller means electrically connected intermediate said DC voltage source and said rail means, and switch means mounted on said controller means for the manual selective controlling of the polarity of the DC voltage applied to said rail means.

12. A toy vehicle as claimed in claim 6, including means coupling said motor means and said at least one wheel for driving said at least one wheel in a forward direction in response to both directions of rotation of said motor means.

* * * * *